United States Patent [19]

Schrencongost

[11] 4,282,791

[45] Aug. 11, 1981

[54] KEYER SYSTEM FOR AN ELECTRONIC ORGAN

[75] Inventor: Ray B. Schrencongost, Park Ridge, Ill.

[73] Assignee: Marmon Company, Chicago, Ill.

[21] Appl. No.: 106,724

[22] Filed: Dec. 26, 1979

[51] Int. Cl.[3] ..... G10H 1/053; G10H 1/08

[52] U.S. Cl. ..... 84/1.26; 84/1.13; 84/1.23

[58] Field of Search ..... 84/1.11, 1.13, 1.19, 84/1.22, 1.23, 1.26

[56] References Cited

U.S. PATENT DOCUMENTS 3,636,231 1/1972 Schrecongost et al. ..... 84/1.23

*Primary Examiner*—S. J. Witkowski

*Attorney, Agent, or Firm*—Neuman, Williams, Anderson & Olson

[57] ABSTRACT

A keying system provides selectable decay times for individual frequency components of a tone to be generated by an electronic organ having a top octave generator producing a multiplicity of rectangular wave signals, and a plurality of associated divider circuits. The keying system comprises a keying block having a plurality of keyer sections. Each keyer section has a first keyer channel comprising at least two MOSFET transistors which are connected in series. At least one keying section further comprises a second keyer channel similar to the first keyer channel, a voltage threshold circuit which has a selectable threshold and switching circuitry to select output signals from either the first or second keyer channel of the one keying section. Each channel of the keying block is connected between a supply voltage and a load resistor which is in turn connected to a reference potential. Rectangular wave signals from the top octave generator and divider circuits are applied to the gates of a first transistor in all keyer channels of the keying block. Upon the depression of a key on a playing keyboard, a keyer envelope signal is directly applied to the gate of a second transistor of all first channels of all keyer sections; and the keyer envelope signal is applied to the gate of a second transistor of the second keyer channel of the one keyer section through the threshold circuit. The output signals from the first keyer channels are rectangular waves modulated by the keyer envelope signal. The output signals from the second channel of the one keyer section are rectangular waves modulated by the keyer envelope signal shifted by the threshold of the voltage threshold circuit. The modulated rectangular wave signals from the first channels of the keyer sections and the selected channel of the one keyer section are passed through filters and combined by output circuitry to sound the desired tones.

14 Claims, 4 Drawing Figures

TOP OCTAVE GENERATOR AND DIVIDER CIRCUIT
12
1760
20
880
18
440
16
220
14
10a
10b
10c
10d
22
24
26
28
30
50
52
54
56
58
60
66
32
34
36
38
40
41
42
44
46
48
-V
10
64
FILTERS
68
OUTPUT SECTION

TIME
70
72
32a
32b
-5
-10
-15
-20
-25
-V

KEYER SYSTEM FOR AN ELECTRONIC ORGAN

BACKGROUND OF THE INVENTION

This invention is directed to keyer circuits for use in electronic organs and more particularly to a keyer circuit for enhancing tones generated on electronic synthesis and formant organs.

The synthesis electronic organ is based upon the knowledge that sustained, complex musical tones can be synthesized by mixing properly scaled sine waves having frequencies representative of the fundamental and the various harmonics of the tone to be synthesized. This can be accomplished by having each organ playing key operate a group of contacts to connect the output signals from various harmonic generators to corresponding harmonic buses which are combined to form a synthesized tone. This is referred to as alternating current (AC) keying.

The formant electronic organ uses as starting signals so-called "bright waves" or signals which are rich in harmonic content including a fundamental frequency and a full complement of harmonics. Formant filter circuits which resonate or otherwise discriminate on a frequency basis are then used to remove unwanted harmonics and alter the harmonic balance of these complex signals to arrive at desirable tone signals. The formant system does not have the choice of tone coloration available with the synthesis approach, however, since it is not necessary to key the multiplicity of signals representative of the fundamental and various harmonics separately, fewer contacts are required in an AC keying system.

AC keying provides great control of tone quality since the level of the fundamental and each harmonic waveform is independently selected as desired. However, the multiple contacts of AC keying systems tend to make the playing key action too stiff for some people. Also, the multiple contacts needed in AC keying systems must be of high quality, since the tone components are switched at low signal levels. These high quality multiple contacts are quite expensive. In the standard type synthesis organ 61 sets of these expensive multiple contact switches are necessary which adds considerably to the overall cost of the organ. Furthermore, even high quality multiple contact switches are prone to failure at one or more contact points due to normal wear, dust and alignment problems and these failures result in the production of a distorted or harmonically incomplete tone signal.

The disadvantages of AC keying lead to the development of direct current (DC) keying wherein a DC signal controls a switching device which passes the AC signals while the device is activated. DC keying allows the use of a single contact per playing key and is utilized in both formant and synthesis organs.

An improved electronic organ DC keyer system is disclosed in U.S. Pat. No. 3,636,231 which provides the benefits of AC keying for synthesis organs but requires only one contact per playing key. Each keyer circuit comprises a plurality of keyer sections with one keyer section for the fundamental frequency and additional keyer sections for each of the desired harmonics of the fundamental frequency which make up the musical note or tone which is to be synthesized by the organ. By depressing the playing key and thereby closing the single contact the associated keyer circuit is operated.

Each keyer section comprises two transistors connected in series. Rectangular wave signals corresponding to the frequency of the fundamental and its harmonics are produced by a top octave generator and a series of dividers. One of the transistors of each keyer section is controlled by a selected one of these rectangular wave signals. A keyer input signal generated by the depression of each playing key controls all of the other transistors of the keyer circuit. Each keyer section produces a modulated rectangular wave signal output which is filtered to obtain an output signal which is substantially a modulated sine wave. Finally, the output signals from the keyer sections of a keyer circuit for a selected note are combined and passed to an output section to synthesize that note.

Of course, the DC keyer circuit of the above-identified patent can also be used in a formant organ. For use in a formant organ, bright waves are applied as tone input signals to the individual keyer sections. The keyer sections are similarly driven by a keyer envelope signal resulting in modulated bright wave output signals which are passed to formant filter circuits. The output signals from the formant filters are passed to an output section to sound the desired tones.

In keyer circuits for both synthesis and formant organs it is advantageous to provide an arrangement for controlling the tone envelope, i.e., the rate of attack and decay of the tone signal, to avoid transients which introduce "thumps" and other objectionable noise and also to achieve various desirable special effects. To achieve this purpose the keying signal from the playing key to a keyer circuit has a defined envelope, i.e., the rate of attack and decay of the keyer input signal is controlled.

Prior art arrangements provide only a single keying envelope signal to a given keyer circuit which controls the attack and decay time for the keyer input signal controlling the fundamental and harmonics or the bright wave signals. If a different tone signal is desired, it is known to change the keyer envelope signal; however, still only one envelope signal is applied to a keyer circuit at a time. For example, a keying envelope signal with a fast rise and slow decay time might be provided to the keyer circuit to generate a percussion tone. Although such envelope changes improve the tones generated, truly realistic tone production would require multiple keying signals with differing envelopes to be applied simultaneously to the same keyer circuit to independently control the attack and decay times for the fundamental and the harmonic components or the bright wave signals. Existing keyer circuits cannot be operated by multiple keying signals and, in any event, the use of such multiple keying signals would produce difficult timing and circuit design problems.

More particularly, many tones have components which have differing decay times, e.g., percussion tones wherein the initial strike components die away rapidly and the accompanying lower frequency components die away gradually over a substantially longer period of time. Such tones cannot be accurately synthesized by existing keyer circuits which receive a single keyer envelope signal.

SUMMARY OF THE INVENTION

The present invention overcomes these shortcomings of the prior art by providing more accurate production of tones having different decay times, such as percussion tones, while retaining the advantageous single keyer envelope signal per keyer circuit.

The present invention is a keying system for an electronic organ which utilizes a multiplicity of rectangular wave tone signals which are produced by a top octave generator and divider circuit. The keying system comprises a keying block having a plurality of keying sections. Each keying section comprises two semiconductor elements, such as transistors, connected in series with the series combination connected between a supply voltage and a load resistor which is in turn connected to a reference potential. At least one of the keying sections further comprises voltage threshold means having a selectable threshold. Rectangular wave signals from the top octave generator and divider circuit are applied to the inputs of one of the transistors in each of the keying sections of the keying block. Upon depression of a playing key by the instrument player, a keyer envelope signal is applied to the other transistor of all of the keying sections either directly or through the voltage threshold means. The voltage threshold means is incorporated into the other transistor or comprises a separate voltage threshold circuit. The output signals of the keyer sections are rectangular waves modulated by the keyer envelope signal and the keyer envelope signal shifted by the threshold of the voltage threshold means. The modulated rectangular wave signals are passed through filters and combined by output circuitry to form the desired tones. This keyer system structure varies the decay time of at least one of the individual components which make up a tone to more accurately product that tone.

Advantageously, a keyer system in accordance with the present invention provides more realistic tone production by providing differing decay times for the individual components of the tone.

In accordance with one aspect of the present invention alternate decay times can be selected for one or more of the components of a given tone. Furthermore, the keyer system provides selectable decay times for one or more of the individual frequency components while permitting the continued use of a single keyer envelope signal per keyer circuit.

BRIEF DESCRIPTION OF THE DRAWING

The invention will be better understood from the following detailed description of the preferred embodiment when read with reference to the drawing in which.

DESCRIPTION OF THE PREFERRED EMBODIMENT

Figure 1:
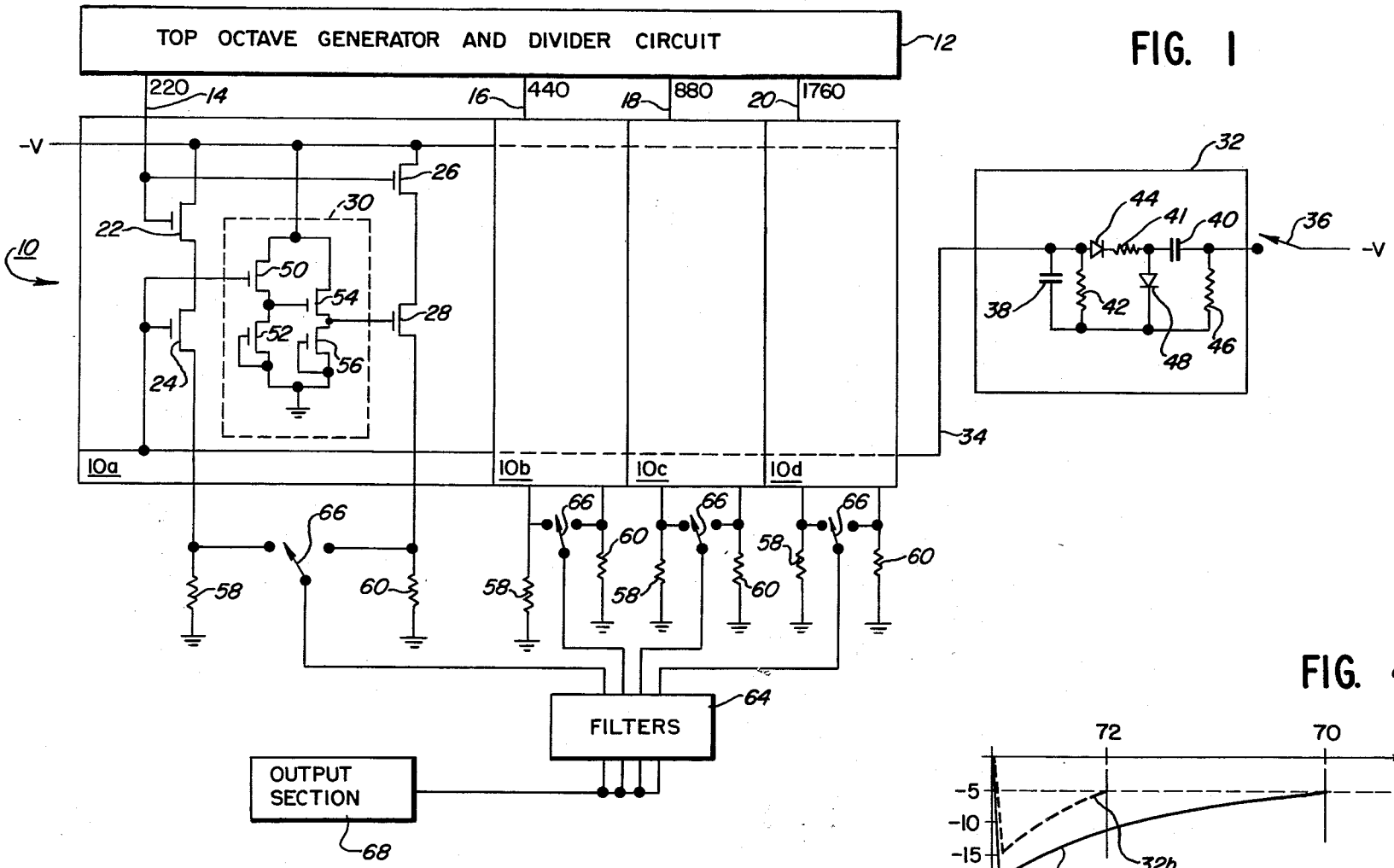
FIG. 1 is a schematic diagram of a keyer circuit in accordance with the present invention.

It is to be understood that the keyer circuit of the present invention is equally applicable to a synthesis organ, a formant or "bright wave" organ or any other electronic instruments to which the invention can be reasonably adapted. Referring to FIG. 1, a single keying block is indicated at 10 and is organized to provide the keying functions for all the signals called upon to supply tones for a particular organ playing key. The keying block for the A 440 hertz note having its fundamental frequency at 440 hertz is the only keying block shown since other playing keys are identical but with different connections as will be evident.

A top octave generator and divider circuit 12 provides the rectangular wave signals for the organ including the necessary signals to generate the A note. A 220 hertz signal is connected to a conductor 14 and 440 hertz, 880 hertz and 1760 hertz signals are connected respectively to conductors 16, 18 and 20.

These signals supply rectangular waves having fundamental components at the frequencies designated and accompanied by a declining series of harmonic components as is characteristic of rectangular wave signals. These signals also supply, where appropriate, the inputs to other keyer blocks for other playing keys. For example, the 440 hertz signal supplies the fundamental tone to the block shown. It also supplies the second harmonic for the A key which is an octave lower, the fourth harmonic for the A key which is two octaves lower, and so on. This general arrangement of multiple use of signals is well known in electronic organs. It is to be noted that the keyer circuit of the illustrative embodiment includes only four keying sections for ease of description. However, the present invention is applicable to keyer circuits having any number of keying sections such as the keyer circuit in U.S. Pat. No. 3,636,231 which includes nine keying sections per keyer circuit.

The keying block 10 is of the MOSFET (Metal Oxide Silicon Field Effect Transistor) integrated circuit type, with all the active elements formed on a single chip of material. These transistors are well known in the art and have the characteristics that conduction between the drain, or input, and the source, or output, depends upon the potential at the gate, or control, relative to the source. The more negative the gate beyond a threshold level, the greater the conduction, for a "P"-type enhancement MOSFET.

The left-most keyer section 10*a* is representative of the other identical keyer sections 10*b*, 10*c* and 10*d*. Each keyer section includes four MOSFET transistors indicated in 10*a*, as 22, 24, 26 and 28 and a voltage threshold circuit 30 which itself includes four MOSFET transistors and will be described hereinafter. The drains of the input transistors 22 and 26 of each keyer section are connected to a source of negative DC potential. The gates of the two input transistors 22 and 26 are connected to their respective rectangular wave signals generated by the top octave generator and divider circuit 12 and the source of each input transistor 22, 26 is connected to the drain of its associated output transistor 24 and 28 respectively. The gates of each of the output transistors 24 of all of the keyer sections are connected internally on the MOSFET chip and in turn connected to the keyer circuit 32 via the conductor 34.

A negative DC supply, for example −25 volts, is connected to the keyer circuit 32 through normally open contacts 36 which are a part of the organ playing key for the A-playing key having its fundamental at 440 hertz. When the playing key is depressed, the contacts 36 close and when the key is released, the contacts 36 separate. The continuous application of the negative DC potential to the keyer circuit 32 causes it to generate the keyer envelope signal 32*a* shown by the solid line in FIG. 4. The illustrated keyer circuit 32 is a percussion keyer circuit; however, it is to be understood that other keyer circuits could be utilized in the invention.

Whenever the A-playing key is depressed and held down to close the contacts 36, the voltage on the conductor 34 goes rapidly to about 80% of the negative potential connected to the contacts 36. This is due to the voltage division between capacitor 38 and capacitor 40.

The capacitor 38 has approximately one-fifth the capacitance and serves to prevent an abrupt voltage transition on the keying envelope signal. After the initial division of voltage between the capacitor 38 and the capacitor 40, the capacitor 40 charges through resistor 41, resistor 42 and a diode 44. The time constant established primarily by the capacitor 40 and the resistor 42 define the keyer envelope signal 32*a* shown by the solid line in FIG. 4. When the A-playing key is released to open the contacts 36, the capacitor 38 discharges through the resistor 42 and the capacitor 40 discharges through a resistor 46 and a diode 48. The diodes 44 and 48 allow different charge and discharge rates for the capacitor 40 and protect the MOSFET keyer block 10.

The voltage threshold circuit 30 is connected between the keyer envelope signal on the conductor 34 and the gate of the transistor 28 in each of the keyer sections 10*a*–10*d*. The voltage threshold circuit 30 comprises two voltage follower circuits comprising the transistors 50, 52 and 54, 56, respectively. The transistors 52 and 56 are of the depletion type and have their gates connected to their sources to form the MOSFET equivalent of a resistor. The source or output of the transistor 50 is connected to the gate of the transistor 54. Accordingly, the input signal to the gate of the transistor 54 is the keyer envelope signal from the keyer circuit 32 shifted by the threshold voltage of the transistor 50 and the output of the transistor 54 is the output signal from the transistor 50 shifted by the threshold voltage of the transistor 54. The shifted keyer envelope signal from the transistor 54 is applied to the gate of the transistor 28. The threshold voltage of the transistors 50 and 54 can be selected during manufacture of the MOSFET circuit so that a voltage shift in the keyer envelope signal in the approximate range of from three to ten volts is obtained. The voltage shift for the combination of the transistors 50 and 54 is determined by the desired decay time for the component of the tone to be generated by the corresponding transistors 26 and 28. The voltage threshold circuit 30 effectively reduces the magnitude of the voltage level of the keyer envelope signal to the transistor 28 to correspondingly reduce the decay time of the component generated by the transistor 28 as is more fully described hereafter with reference to FIG. 4.

It will be apparent to those skilled in the art that a keyer transistor such as the transistor 28 can itself be manufactured to have a threshold level which differs from those of the other transistors on the same integrated circuit chip. Thus, it is possible to provide the variable decay times by the manufacturing process applied to the individual keyer transistors 28 of the keyer sections. Such processing of the keyer transistors 28 allows the elimination of the voltage threshold circuit 30 from the keyer sections which are equipped with the modified keyer transistors. However, the variations which are possible in the threshold of an individual device are limited and the variations which can be obtained in the decay time of a component keyed by such a keyer section are similarly limited. Modified keyer transistors can be utilized if satisfactory differences in decay time can be obtained. Otherwise, the voltage threshold circuit 30 is provided to extend the ranges of decay time which are possible in the keyer circuit. Also, modified keyer transistors can be used together with the voltage threshold circuit 30 to obtain still wider ranges of decay times.

The sources of the output transistors 24 of the keyer sections 10*a* through 10*d* are individually connected to load resistors 58 while the sources of the output transistors 28 are individually connected to the load resistors 60. Each of the load resistors is connected to ground or other suitable reference potential. Each of the keyer sections 10*a* through 10*d* accordingly provides two output signals, one at its associated load resistor 58 and the other at its associated load resistor 60. The output signal at the load resistor 58 has a decay time which is determined by the envelope signal generated by the keyer circuit 32; the output signal at the resistor 60 has a decay time determined by the envelope signal generated by the keyer circuit 32 shifted by the selected voltage threshold of the voltage threshold circuit 30. These output signals are selectively routed to the filters 64 by means of the two position switches 66 which are individually associated with the keyer sections 10*a* through 10*d*. The filtered output signals from the filters 64 are combined and passed to the output section 68 to generate the desired tone.

Figure 4:
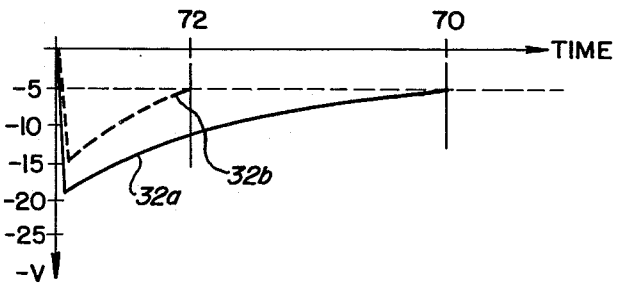
FIG. 4 is a graph of a keyer envelope signal.

The effect of the selectable voltage threshold for the keyer sections is most easily seen in FIG. 4. As previously noted, the conduction of the output transistors 24 and 28 depends upon the potential at the gate relative to the source. Accordingly, the voltage shift through the voltage threshold circuit 30 for the output transistors 28 determines the portion of the keyer envelope signal shown in FIG. 4 which is sufficiently negative to place the output transistors 28 into their conductive states. For example, if the voltage shift of the keying envelope signal is 0 volts as is the case for the transistors 24, then the entire keyer envelope signal 32*a* to the point in time 70 will activate those output transistors and provide a relatively long decay time for those particular components. On the other hand, if the keyer envelope signal is shifted by a voltage of approximately seven volts, only the lower section of the envelope signal will serve to activate the output transistor 28 and a transistor receiving such a signal will remain active to the reduced point in time 72. It should be observed that such a voltage shift of the keyer envelope signal is the equivalent of having a keying envelope signal 32*b* as indicated by the dashed line in FIG. 4 applied to the gate of the associated output transistor.

The switches 66 are operated to select the decay times for the individual components of a tone to be generated. Of course, the switches 66 can be operated individually or ganged together to provide various desirable effects as is well known in the electronic organ art. It is to be understood that all keyer sections do not have to be identical and that some keyer sections could include only the transistors 22 and 24 while other keyer sections could include only the transistors 26, 28 and the voltage threshold circuit 30. Such combinations could give various desirable effects and provide simpler circuits by eliminating various ones of the load resistors 58 and 60 and the switches 66.

Figure 2:
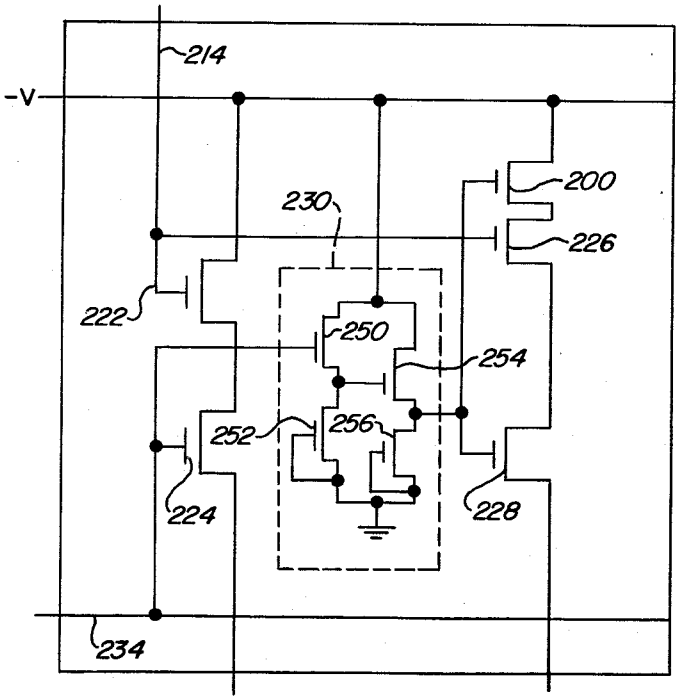

FIG. 2 shows an alternate embodiment of the keying sections 10*a* through 10*d* of FIG. 1. Like elements of the embodiment of FIG. 2 are similarly numbered but in the 200 series of numbers. Rectangular wave signals are provided to the gates of the tone signal transistors 222 and 226 via the conductor 214 and the keying envelope signal is provided to the gates of the transistors 224 and 250 via the conductor 234. The voltage threshold circuit 230 functions the same as the voltage threshold circuit 30 previously described. A keyer transistor 200 is provided in addition to the keyer transistor 228 to provide additional isolation for the component provided by the transistor 226. The output of the voltage threshold circuit 230 is connected to the gates of the transistors 200 and 228 to provide a voltage shifted keying signal to those transistors as previously described with reference to FIG. 4.

Figure 3:
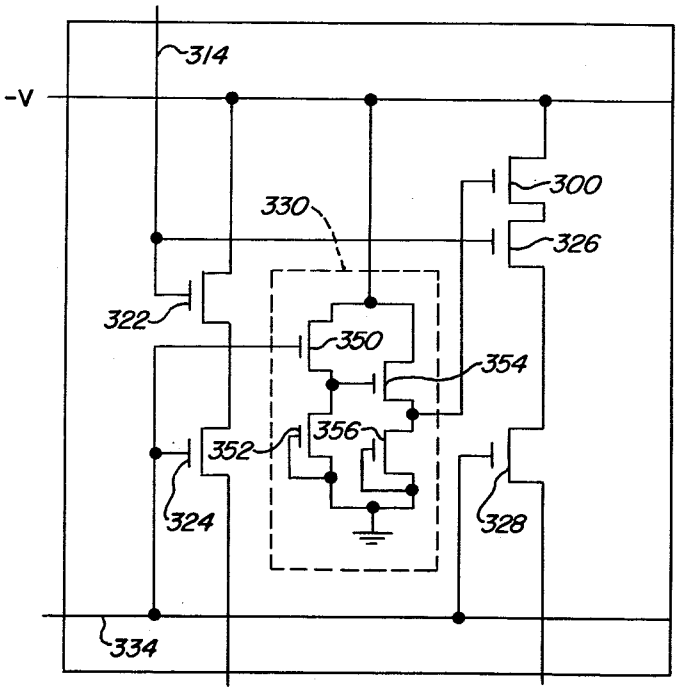
FIGS. 2 and 3 are schematic diagrams of alternate embodiments of the individual keying sections of a keying block in accordance with the present invention.

FIG. 3 shows another alternative embodiment of the keyer sections 10*a* to 10*d* of FIG. 1 with elements corresponding to the elements in FIG. 1 similarly numbered but in the 300 series of numbers. The rectangular wave signal is provided to the tone input transistors 322 and 326 via the conductor 314. A keying envelope signal is provided to the gates of the transistors 324, 328 and 350 via the conductor 334. The operation of the voltage threshold circuit 330 which is driven by the keying envelope signal via the gate of the transistor 350 is identical to the operation of the voltage threshold circuit 30 as previously described. The additional keying transistor 300 is driven by the output of the voltage threshold circuit 330 to provide a modulated input voltage to the transistor 326 and provides for the reduced decay time as previously described with reference to FIG. 4. As is evident, the transistor 328 will be active whenever the transistor 300 is active to pass the modulated output signal to the output of the keyer section.

From the above description, it is apparent that the present invention allows the generation of notes or tones which include individual components having differing decay times while utilizing a single keyer envelope signal. It will be recognized that the attack time of an envelope signal is also varied by the present invention although to a much lesser extent. Should it be desirable to significantly modify the attack time between keying sections it will be understood that an attack waveform similar to the decay waveform would allow such modifications in accordance with the present invention. While only certain embodiments have been set forth, alternate embodiments and various modifications will be apparent from the above description to those skilled in the art. For example, the use of various voltage threshold circuits which differ from the described embodiment or external voltage threshold circuits can be utilized. Similarly, the use of additional voltage threshold circuits in a single keyer section are possible to provide a plurality of decay times for a given tone component. These and other alternatives are considered equivalents and within the spirit and scope of the present invention.

What is claimed is:

1. A keying system for use in an electronic organ having a top octave generator and divider circuit for providing a plurality of rectangular wave signals at various frequencies and a keyboard for providing a keying signal upon depression of any key, said keying system comprising:

a keying block having a plurality of keying sections each of said keying sections having at least a first and a second semiconductor switching element, all of said semiconductor elements having an input, a control and an output;

a source of direct current potential and a source of reference potential, said direct current potential being connected to the input of the first semiconductor element of each of said sections;

first conductor means for connecting the output of the first semiconductor element of each section to the input of the second semiconductor element of the same section;

a plurality of load resistors connected individually between the outputs of said second semiconductor elements and said source of reference potential;

second conductor means for connecting the rectangular wave signals from said top octave generator and divider circuit individually to the controls of the first semiconductor elements of each section; and envelope means including a source of keying potential for applying an envelope signal to the controls of the second semiconductor elements of said keying sections upon depression of a key on said keyboard characterized in that at least one of said second semiconductor elements has a selectable threshold of conductivity which differs from the threshold of conductivity of the second semiconductor elements of the other keying sections whereby the decay time of the component keyed by said at least one keying section is selectable and differs from the decay times for the components keyed by said other keying sections.

2. A keying system for use in an electronic organ having a top octave generator and divider circuit for providing a plurality of rectangular wave signals at various frequencies and a keyboard for providing a keying signal upon depression of any key, said keying system comprising:

a keying block having a plurality of keying sections, each of said keying sections having a keying section input terminal and keying section output terminal and having a first and a second semiconductor switching element, all of said semiconductor elements having an input, a control and an output, wherein the control of said second semiconductor element is connected to said keying section input terminal and the output of said second semiconductor element is connected to said keying section output terminal;

a direct current supply connected to the input of the first semiconductor element of each of said sections and having a reference potential;

first conductor means for connecting the output of the first semiconductor element of each section to the input of the second semiconductor element of the same section;

a plurality of load resistors connected individually between the outputs of said second semiconductor elements and said reference potential;

at least one of said sections further comprising voltage threshold means inserted between said keying input terminal and the control of said second semiconductor element for passing a portion of an applied signal which exceeds a selectable threshold;

conductor means for connecting the rectangular wave signals from said top octave generator and divider circuit individually to the controls of the first semiconductor elements of each section; and envelope means including a source of keying potential for applying an envelope signal to the keying input terminal of said keying sections upon depression of a key on said keyboard whereby the decay time of the frequency component keyed by said at least one of said sections is selectable and differs from the decay times for the frequency components keyed by the other sections.

3. A keying system for use in an electronic organ having a top octave generator and divider circuit for generating a plurality of rectangular wave signals at various frequencies and a keyboard for providing a keying signal upon depression of any key, said keying system comprising:

a keying block having a plurality of keying sections, each of said keying sections having an output terminal and a first and a second semiconductor switching element all of said semiconductor elements having an input, a control and an output;

a direct current supply connected to the input of the first semiconductor element of each of said sections and having a reference potential;

first conductor means for connecting the output of the first semiconductor element of each section to the input of the second semiconductor element of the same section and for connecting the output of the second semiconductor element of each section to the output terminal of the same section;

at least one of said keying sections further comprising:

a third and a fourth semiconductor switching element each having an input, a control and an output with the input of the third semiconductor element connected to said direct current supply;

second conductor means for connecting the output of the third semiconductor element to the input of the fourth semiconductor element and for connecting the control of the first semiconductor element to the control of the third semiconductor element;

voltage threshold means connected to the control of the fourth semiconductor element for passing a portion of an applied signal which exceeds a selectable threshold; and switching means inserted between the output of the second semiconductor element and the keying section output terminal for selectively connecting the output of the second semiconductor element and the output of the fourth semiconductor element to said keying section output terminal;

a plurality of load resistors connected individually between the outputs of said second and fourth semiconductor elements and said reference potential;

third conductor means for connecting the rectangular wave signals generated by the top octave generator and divider circuit individually to the controls of the first semiconductor elements of each section; and envelope means including a source of keying potential for applying an envelope signal to the controls of the second semiconductor elements and to said voltage threshold means upon depression of a key on said keyboard.

4. A keying system for use in an electronic organ having a top octave generator and divider circuit for providing a plurality of rectangular wave signals at various frequencies and a keyboard for providing a keying signal upon depression of any key, said keying system comprising:

a keying block having a plurality of keying sections, each of said keying sections having an output terminal and a first and a second semiconductor element, all of said semiconductor elements having an input, a control and an output;

a direct current supply connected to the input of the first semiconductor element of each of said keying sections and having a reference potential;

first conductor means for connecting the output of the first semiconductor element of each section to the input of the second semiconductor element of the same section and for connecting the output of the second semiconductor element of each section to the output terminal of the same section;

at least one of said keying sections further comprising:

third, fourth and fifth semiconductor elements each having an input, a control and an output with the input of the third semiconductor element being connected to said direct current supply;

second conductor means for connecting the output of the third semiconductor element to the input of the fourth semiconductor element, for connecting the output of the fourth semiconductor element to the input of the fifth semiconductor element and for connecting the control of the first semiconductor element to the control of the fourth semiconductor element;

voltage threshold means connected to the control of the third semiconductor element and the control of the fifth semiconductor element for passing a portion of an applied signal which exceeds a selectable threshold; and switching means inserted between the output of the second semiconductor element and the keying section output terminal for selectively connecting the output of the second semiconductor element and the output of the fifth semiconductor element to the keying section output terminal;

a plurality of load resistors connected individually between the outputs of said second and fifth semiconductor elements and said reference potential;

third conductor means for connecting the rectangular signals from said top octave generator and divider circuit individually to the controls of said first semiconductor elements of each keying section; and envelope means including a source of keying potential for applying an envelope signal to the controls of the second semiconductor elements of said keying sections and to said voltage threshold means upon depression of a key on said keyboard.

5. A keying system for use in an electronic organ having a top octave generator and divider circuit for providing a plurality of rectangular wave signals at various frequencies and a keyboard for providing a keying signal upon depression of any key, said keying system comprising:

a keying block having a plurality of keying sections, each of said keying sections having an output terminal and a first and a second semiconductor element, all of said semiconductor elements having an input, a control and an output;

a direct current supply connected to the input of the first semiconductor element of each of said sections and having a reference potential;

first conductor means for connecting the output of the first semiconductor element of each section to the input of the second semiconductor element of the same section and for connecting the output of the second semiconductor element of each section to the output terminal of the same section;

at least one of said keying sections further comprising:

third, fourth and fifth semiconductor elements each having an input, a control and an output with the input of the third semiconductor element being connected to said direct current supply;

second conductor means for connecting the output of the third semiconductor element to the input of the fourth semiconductor element, for connecting the output of the fourth semiconductor element to the input of the fifth semiconductor element and for connecting the control of the first semiconductor element to the control of the fourth semiconductor element;

voltage threshold means connected to the control of said third semiconductor element for passing a portion of an applied signal which exceeds a selectable threshold; and switching means inserted between the output of the second semiconductor element and the keying section output terminal for selectively connecting the output of the second semiconductor element and the output of the fifth semiconductor element to the keying section output terminal;

a plurality of load resistors connected individually between the outputs of said second and fifth semiconductor elements and said reference potential;

third conductor means for connecting the rectangular wave signals individually to the controls of said first semiconductor elements of each section; and envelope means including a source of keying potential for applying an envelope signal to the controls of the second and fifth semiconductor elements and to said voltage threshold means upon depression of a key on said keyboard.

6. The keying system in accordance with claims 1, 2, 3, 4, or 5 wherein said semiconductor elements comprise field effect transistors and said control comprises a gate.

7. The keying system in accordance with claim 2, 3, 4 or 5 wherein said voltage threshold means comprises: a series parallel combination of four field effect transistors, all of said field effect transistors having an input, a gate and an output with the inputs of the first and the third transistors being connected to said direct current supply, the outputs of the first and third transistors connected to the inputs of the second and fourth transistors respectively, the outputs of the second and fourth transistors being connected to said reference potential, the gates of the second and fourth transistors being connected to their respective outputs and the gate of the third transistor being connected to the output of the first transistor, wherein said voltage threshold means includes an input which comprises the gate of the first transistor thereof and an output which comprises the output of the third transistor thereof.

8. The keying system in accordance with claim 7 wherein said semiconductor elements comprise field effect transistors and said control comprises a gate.

9. An electronic organ having a top octave generator and divider circuit for generating a plurality of rectangular wave signals at various frequencies, a keyboard for providing a keying signal upon depression of any key and a keying system receiving said rectangular wave signals and said keying signal and providing a tone signal output, said keying system comprising:

a keying block having a plurality of keying sections, each of said keying sections having an output terminal and a first and a second semiconductor switching element all of said semiconductor elements having an input, a control and an output;

a direct current supply connected to the input of the first semiconductor element of each of said keying sections and having a reference potential;

first conductor means for connecting the output of the first semiconductor element of each section to the input of the second semiconductor element of the same section;

a first plurality of load resistors connected individually between the outputs of said second semiconductor elements and said reference potential;

second conductor means for connecting the rectangular wave signals generated by the top octave generator and divider circuit individually to the controls of the first semiconductor elements of each keying section; and envelope means including a source of keying potential for applying an envelope signal to the control of the second semiconductor elements upon depression of a key on said keyboard, characterized in that each of said keying sections further comprises:

a third and a fourth semiconductor switching element each having an input, a control and an output with the input of the third semiconductor element connected to said direct current supply;

third conductor means for connecting the output of the third semiconductor element to the input of the fourth semiconductor element and for connecting the control of the first semiconductor element to the control of the third semiconductor element;

voltage threshold means connected to the control of the fourth semiconductor element and to said envelope means for receiving said envelope signal and passing a portion of said envelope signal which exceeds a selectable threshold;

a second plurality of load resistors connected between the outputs of said fourth semiconductor elements and said reference potential; and switching means for selectively connecting the output of the second semiconductor element and the output of the fourth semiconductor element to said keying section output terminal.

10. The electronic organ of claim 9 further comprising:

a group of filters connected individually to said keying section output terminals for summing and filtering the signals from said keying sections; and a common output circuit connected to receive the output signals from said filters and to sound a tone in response thereto.

11. An electronic organ having a top octave generator and divider circuit for providing a plurality of rectangular wave signals at various frequencies, a keyboard for providing a keying signal upon depression of any key and a keyer system receiving said rectangular wave signals and said keying signal and providing a tone signal output, said keyer system comprising:

a keying block having a plurality of keying sections, each of said keying sections having an input terminal and a first and second semiconductor switching element, all of said semiconductor elements having an input, a control and an output;

a direct current supply connected to the input of the first semiconductor element of each of said keying sections and having a reference potential;

first conductor means for connecting the input terminal of each section to the control of the second semiconductor element of that section and for connecting the output of the first semiconductor element of each section to the input of the second semiconductor element of the same section;

a plurality of load resistors connected individually between the outputs of said second of said semiconductor elements and said reference potential;

control means inserted between the input terminal and the control terminal of the second semiconductor element in at least one of said keying sections for individually controlling the decay time of the individual tone component generated by said at least one keying section;

second conductor means for connecting the rectangular wave signals from said top octave generator and divider circuit individually to the controls of the first semiconductor elements of each of said keyer sections; and envelope means including a source of keying potential for applying an envelope signal to the input terminal of each of the keyer sections upon depression of a key on said keyboard.

12. The electronic organ of claim 11 wherein said control means comprises a voltage threshold circuit.

13. The electronic organ in accordance with claim 9, 10, 11 or 12 wherein said semiconductor elements comprise field effect transistors and said control comprises a gate.

14. The electronic organ in accordance with claim 13 wherein said voltage threshold means comprises: a series parallel combination of four field effect transistors, all of said field effect transistors having an input, a gate and an output with the inputs of the first and the third transistors being connected to said direct current supply, the outputs of the first and third transistors being connected to the inputs of the second and fourth transistors respectively, and the outputs of the second and fourth transistors being connected to said reference potential, the gates of the second and fourth transistors being connected to their respective outputs and the gate of the third transistor being connected to the output of the first transistors, wherein said voltage threshold means includes an input which comprises the gate of the first transistor thereof and an output which comprises the output of the third transistor thereof.

* * * * *